US012735821B1

(12) United States Patent
Bearden

(10) Patent No.: US 12,735,821 B1
(45) Date of Patent: Sep. 15, 2026

(54) TUFT REPLACEMENT MACHINE AND METHOD THEREFOR

(71) Applicant: John H. Bearden, Marietta, GA (US)

(72) Inventor: John H. Bearden, Marietta, GA (US)

( * ) Notice: Subject to any disclaimer, the term of this patent is extended or adjusted under 35 U.S.C. 154(b) by 0 days.

(21) Appl. No.: 19/399,624

(22) Filed: Nov. 24, 2025

(51) Int. Cl.
*D05C 15/34* (2006.01)
*D05C 15/14* (2006.01)

(52) U.S. Cl.
CPC ..... *D05C 15/34* (2013.01); *D05C 15/14* (2013.01)

(58) Field of Classification Search
CPC ..... D05C 13/02; D05C 15/34; D05C 15/36; D05C 15/24; D05D 2305/36; D05D 2305/50; D05D 2305/08
See application file for complete search history.

(56) References Cited

U.S. PATENT DOCUMENTS 5,979,344 A * 11/1999 Christman, Jr. ..... D05C 15/28 112/80.23
5,989,368 A * 11/1999 Tillander ..... B65H 23/0216 156/379
6,877,449 B2 * 4/2005 Morgante ..... D05C 17/02 112/80.23
8,329,265 B2 * 12/2012 Cook ..... E01C 13/08 428/17
11,840,809 B2 * 12/2023 Lee ..... B32B 7/12
12,006,606 B1 * 6/2024 Vaughan ..... D05C 15/04
12,480,242 B2 * 11/2025 Seaton ..... D05C 15/34
2012/0152159 A1 * 6/2012 Bearden ..... D05C 15/30 112/80.23
2013/0180440 A1 * 7/2013 Hall ..... D05C 15/16 112/80.32
2014/0000497 A1 * 1/2014 Modra ..... D05C 15/12 112/80.32
2020/0283285 A1 * 9/2020 Rodgers ..... B68G 7/08
2023/0183899 A1 * 6/2023 Pongrass ..... D05C 15/30 112/410
2025/0034771 A1 * 1/2025 Seaton ..... D05C 15/26
2025/0059693 A1 * 2/2025 Lovelady ..... D05C 15/36
2025/0376794 A1 * 12/2025 Lovelady ..... D05C 15/12

* cited by examiner

*Primary Examiner* — Danny Worrell
(74) *Attorney, Agent, or Firm* — Invenion Protection Associates, LLC

(57) ABSTRACT

A sheet of artificial athletic turf bearing a graphic design formed by an arrangement of tufts of different colors of grass-simulating synthetic yarns. The backing substrate element of the turf is, first, thoroughly tufted with at least one background color of yarn and prior to permanently binding those tufts to the backing, some of the tufts are removed from the backing, and the area of the backing surface vacated by their removal is repopulated with tufts of supplemental colors of yarn arranged in the pattern of the graphic design.

20 Claims, 4 Drawing Sheets

TUFT REPLACEMENT MACHINE AND METHOD THEREFOR

BACKGROUND OF THE INVENTION

Artificial athletic turf is constructed of fabric backing panels through which filament yarns resembling blades of grass are inserted, via a tufting process, and are then bonded to the backing by applying coating material onto the bottom face of the backing and the backloops of the inserted yarns. When these manufactured panels are installed at the athletic installation site, the tufted backing panels are laid atop a resilient base surface that cushions athletes' joints and gives the turf a more natural ground surface feel. Then, as a final field installation step, a granular mix of small "infill" particles of rubber and sand is poured atop the tufted backing to occupy space between the synthetic grass blades and create a protective barrier between the athletes' cleats and the backing fabric.

Within the tufting process, these backing substrates are usually operated on by conventional broadloom tufting machines configured to produce athletic turf at high throughputs. Typically, these broadloom tufting machines have at least one tufting head assembly featuring an elongate bar of yarn-delivering needles positioned above and aligned transverse to the direction of an elongate sheet of backing fabric that is to be advanced, in stepped progression, past the needles by a feed and take-up roller assembly. Each needle along the needle bar receives a yarn that originates from a designated spool within a yarn creel and is delivered to the needle by a yarn feed mechanism. These broadloom needles are fixed in their relative lateral spacing and span most of the entire transverse width of the backing material that is fed past them. So, as the backing sheet travels past the tufting head, the needle bar is continually reciprocated downward so that needles penetrate and insert yarn into the backing in unison. Meanwhile, an equivalent number of yarn-catching loopers disposed below the backing operate in tandem with the needles in that they each catch the yarn of a downwardly reciprocated needle before it returns upward. This repeated interaction produces "loop pile" tufts which are immediately severed by cooperating knives and transformed into "cut pile" tufts resembling blades of grass. All of this causes longitudinal rows of cut pile tufts to form down the length of the elongate backing sheet panel that is being fed through the broadloom tufting machine.

Of course, because the tufting needles are laterally static, the tufts of each such forming row will be made of a particular yarn that the individual needle creating that row receives from an individual spool—causing each forming row to be of a constant yarn color. So, in the context of manufacturing articles of athletic turf used in American football fields, most of these broadloom needles will tuft rows of green yarn, while a few others tuft rows of white yarn that form continuous line markings that span the full lengths of several segments of backing (and, at upon installation, will be oriented so as to span the width of the football field of play).

However, to varying extents that depend on the design specifications of athletic turf fields being produced, multicolored graphics are also usually required within the fields. Those graphics historically were and, usually, still are created by tufting and coating both: (a) enough rectangular backing panels with yarns of the background grass color (e.g., green) and of certain linear field marking colors (e.g., white) to form an entire athletic field when those background color panels are all laid side-by-side; and (b) an additional amount of smaller panels of supplemental colors of yarn—each such supplemental panel bearing yarn of a color contained somewhere in a graphic design to be displayed within the athletic field. Then, areas of tufted and coated backing are cut out of the background color turf panels to create voids in those panels that can be filled with shaped articles of tufted and coated turf that are cut from the supplemental color turf panels. More specifically, those color pieces are carefully arranged and glued together, in jigsaw fashion, within those background color panel voids to create desired graphics.

This cut and glue inlaying process has its inefficiencies, though. To wit, while the supplemental colors of yarn may be tufted into panels that are considerably smaller than the color panels due to lesser volumes of supplemental colors being needed to complete the various design elements, the process of (1) tufting background colors of yarn into backing sheets and, subsequently, coating those tufted backings to make them field installation-ready turf panels, (2) similarly tufting supplemental colors of yarn into separate backing sheets and coating them as well, (3) cutting various shapes of turf articles from those supplemental color panels, (4) cutting larger contiguous areas of turf out of the background color tufted and coated panels, and (5) inlaying and glueing together, within those cut out areas of the background color panels, the cut out supplemental color articles is a quite laborious one. Moreover, during the tuft insertion phase of that process, assuming that the same machine is used to tuft differently colored panels, between each successive instance of tufting two differently colored panels, the machine's yarn spools must be replaced in order to change out the color of yarn being delivered to each of its tufting needles. It may take 3-4 hours to change, for example, 360 spools of yarn, and it may take 10 minutes to tuft the few feet of each of the supplemental color panels needed to produce desired graphics.

Previously, the present inventor addressed that inefficiency by developing tufting machines for producing athletic turf bearing precise graphic tuft patterns at high throughput rates disclosed in U.S. Pat. Nos. 8,695,519 and 9,051,672 to Bearden. In short, those machines allowed a segment of backing material to be repeatedly traveled, in one manner or another, past a tufting zone comprised of multiple, longitudinally spaced tufting heads that each featured needles that are, themselves, each dedicated and either fixedly or shiftably positioned to deliver a specific color of yarn at a specific lateral position along a segment of backing and to deliver that colored yarn in rows running along the backing segment—including rows spanning less than the full length of that segment if dictated by the planned graphic design.

The reality is, however, that an overwhelming majority of athletic turf manufacturers have not employed that dynamic pattern tufting technology and are, instead, heavily capitally invested in tufting machines equipped to tuft single-colored yarn rows throughout the entire lengths of backing sheets fed to those machines. So, to gain efficiency in the context of using those kinds of conventional tufting machines, the present inventor has developed a machine and method which obsolesces the production work related to tufting and coating separate panels of supplemental colors of yarn. More specifically, the present inventor recognizes that overall production times can be dramatically reduced by fully populating a panel of backing material with only tufts of the background color of yarn and, before bonding those yarn tufts to the backing, using his new, tuft removal and replacement machine to dislodge and remove background color yarn tufts that were placed within certain zones of the panel that mosaics of other colored yarn must reside in order to form desired graphics. Then, rather than cutting zones of tufted, but uncoated, material out of the background color panels—or doing the same to any other colored panels for that matter—additional, replacement tufts of supplemental colors of yarn are dynamically inserted within those background color tuft removal zones to re-populate those areas in a manner that renders desired graphic patterns without any cutting or glueing actions being performed. And it is only after the supplemental colors have been tufted that the step of coating and bonding all of the yarns to that backing material occurs.

SUMMARY OF THE INVENTION

The present invention generally relates to apparatuses and methods for removing yarn tufts from backing fabric substrates of artificial turf and, subsequently, inserting new tufts within the areas vacated by those removals.

In one aspect of the invention, a backing sheet that is already thoroughly tufted with a primarily or background color(s) of yarn is pinned to a tuft removal machine conveyor and, thereby, tensioned multi-directionally. The sheet is advanced as many times as needed past, preferably, multiple robots equipped with tuft extraction devices capable of pulling tufts from designated areas along the backing sheet. Ideally, such a tuft removal machine features an extraction head that has a shield to protect tufts that should remain intact. Nevertheless, within the spirit of the inventive method at least, that removal action could even be manually performed by workers who are positioned in succession along the perimeter of the conveyor. Either way, tufts can be extracted quickly and accurately for recycling, and the conventional needs to (1) tuft other panels of backing with other colors of yarn, (2) cut patches of tufted material from those panels, (3) cut out zones of tufted material from the background color tufted panel, and (4) glue the cut patches within those cut out zones are all obsolesced.

In another aspect of that invention, after the necessary tufts are removed, the backing sheet undergoes a re-tufting process that occurs within the zones of tuft removal. Ideally, the removal machine features a next section that has multiple robots equipped with high-speed mending guns or a gantry element having tufting head assemblies that are mounted to them and are laterally travelable along the gantry. In the areas vacated by tuft removal, supplemental colors of tufts are selectively inserted by these mending guns or gantry-mounted tuft insertion mechanisms so as to create desired color mosaics.

Other vital aspects of the invention are disclosed by the description, claims, and illustrations that follow.

DETAILED DESCRIPTION OF THE PREFERRED EMBODIMENTS

The present disclosure is applicable to creation of artificial athletic turf that bears an artistic design—or at least reflects some degree of color non-uniformity—in the form of recognizable patterns of different colored blades of synthetic grass which are, in fact, cut piles of different colored polypropylene yarn. The hardware aspects of this disclosure are embodied in the accompanying FIGS. 1 & 2, and they concern an apparatus capable of doing the following to a sheet of backing material that was previously tufted with yarns: (1) selectively dislodging and removing certain tufts of yarn from the backing sheet to create a footprint of one or more contiguous or non-contiguous areas of removed tufts; (2) inserting new, replacement yarn tufts within the removal footprint; and (3) bonding the originally and subsequently tufted yarns to the backing in some suitable manner. Additionally, a computer (not shown) is used to control operation of the various mechanisms used in performing those actions in accordance with stored relevant tuft pattern information. For example, the computer stores information and controls the various apparatus mechanisms concerning the areas of tuft removal from an operated upon, uncoated, tufted backing; relative positioning and lengths of new tuft row creation, per colored yarn, to repopulate that removal footprint with; and coordination of conveyor-driven, longitudinal movement of the tufted backing, yarn color determinative needle reciprocation, tuft removal mechanism operation (and maybe movement relative to the backing), and multi-directional tuft insertion mechanism movement (in some embodiments)—all to create a predetermined color design in the backing.

The method aspects of this disclosure are, of course, implemented using the apparatus described above, but they may also be performed using disparate apparatuses or even manually in part. Given that there has never been a plausible motivation for removing and replacing tufts from a tufted backing, except in the context of creating a color pattern in tufted backing not already possessing that pattern, and given that, heretofore, that kind of tuft replacement has been performed, exclusively, on tuft-locked (i.e., coated) backings via the much more invasive process of cutting areas of fabric out of those tufted backings and re-populating those voids with articles of tuft-locked backing that were similarly extracted from other tufted and coated backing sheets, the presently disclosed notion of removing yarn tufts from a yet to be coated backing and inserting tufts in their place prior to the tuft locking process is novel irrespective of the means employed to remove and insert tufts.

Figure 1:
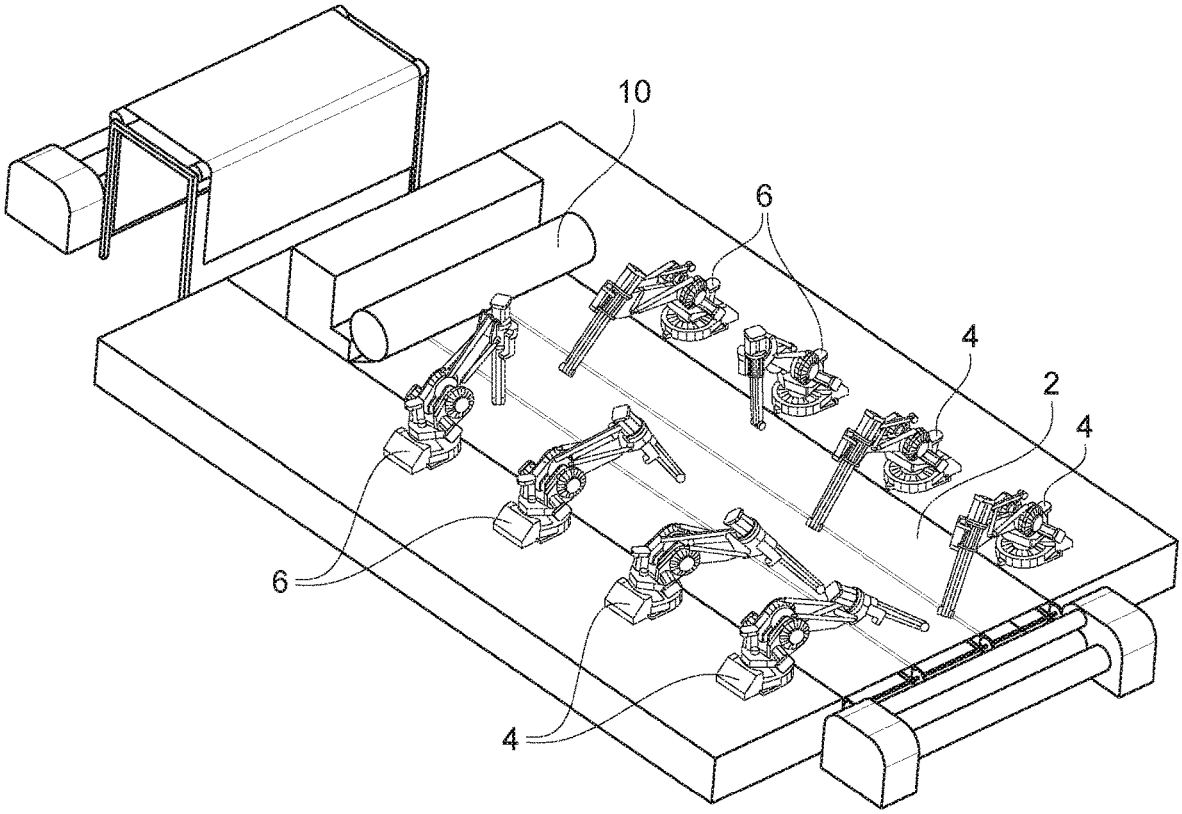
FIG. 1 is a perspective view of a tuft replacing machine of the present invention—one with tuft insertion mechanisms mounted upon a gantry.
Figure 2:
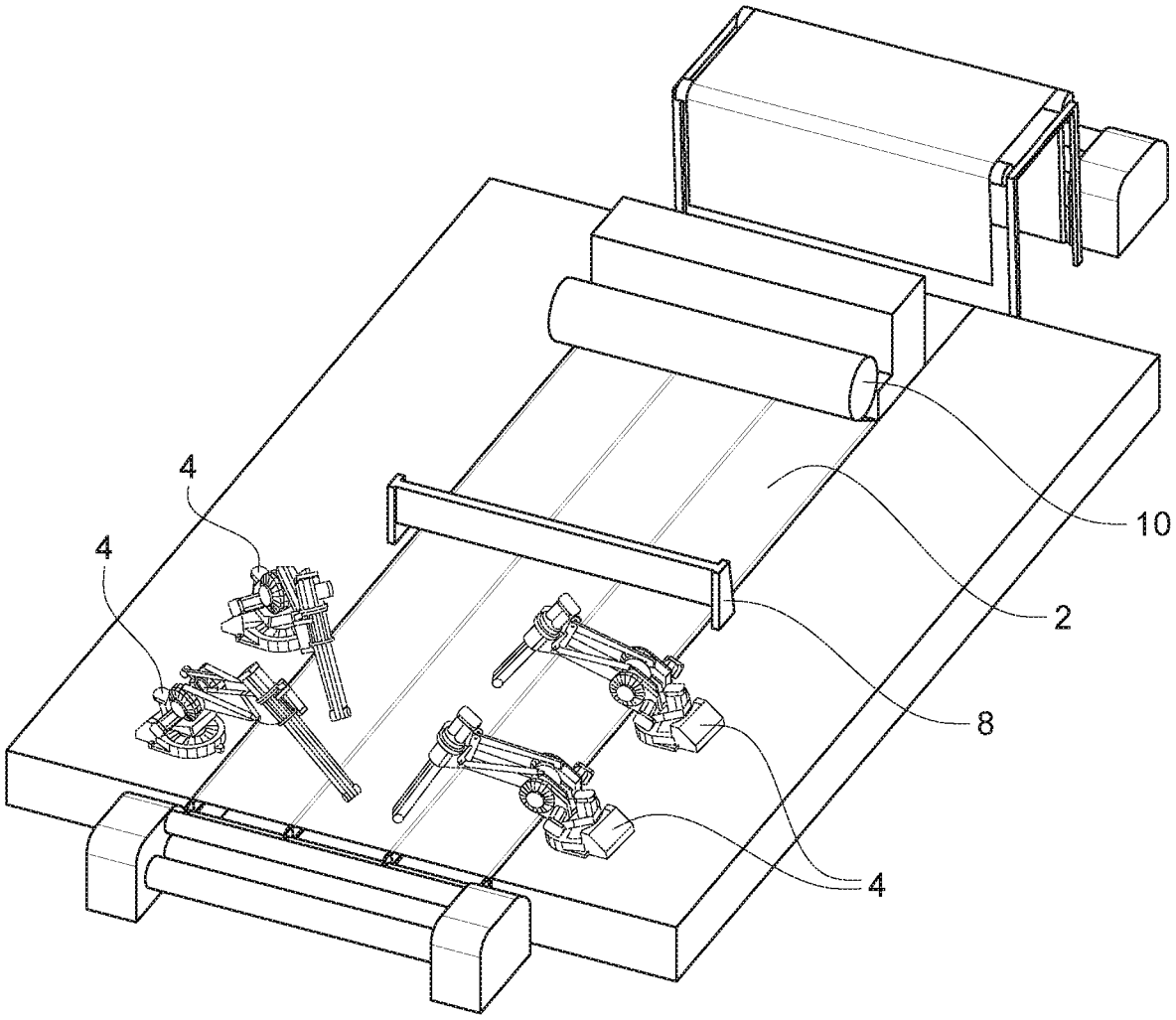
FIG. 2 is a perspective view of another tuft replacing machine of the present invention—one with tuft insertion mechanisms mounted on robots.
Figure 3:
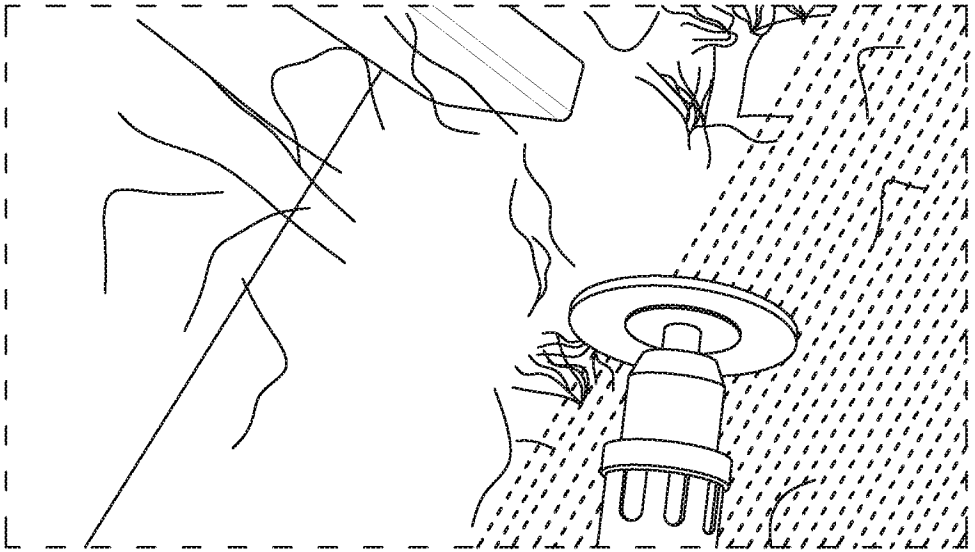
FIG. 3 shows a photograph of a handheld tuft removal device removing yarn tufts, by way of abrasion, from a tufted, uncoated backing within a tuft replacement process of the present invention.
Figure 4:
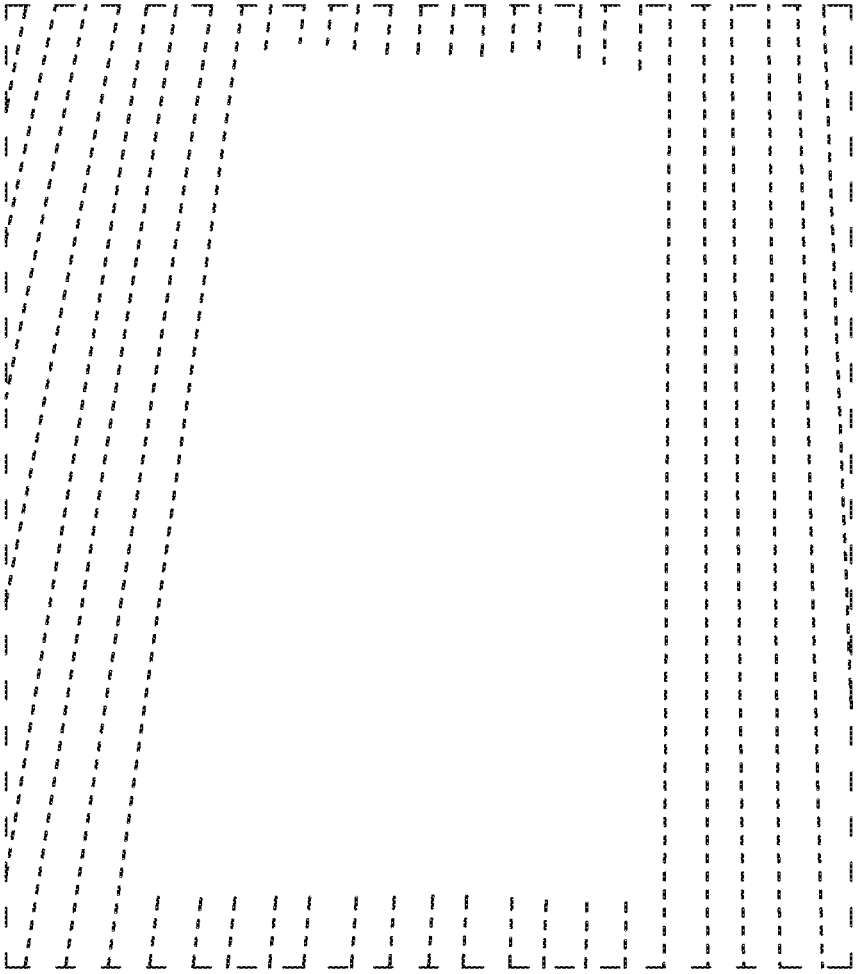
FIG. 4 shows a photograph of a background color tufted panel having a zone of tufts that were removed within a tuft replacement process of the present invention.

Nevertheless, a preferred embodiment of the tuft replacement machine of the present invention is displayed in FIG. 1. Relative to the present tuft replacing process, its essential elements are: (1) a backing retaining mechanism in the form of a pin chain conveyor 2 to which an elongate sheet of backing material can be attached; (2) tuft removal mechanisms 4 (robotic ones in this case); and (3) tuft insertion mechanisms 6 (robotic mending gun ones in this case). An alternative embodiment of a functionally similar machine is depicted in FIG. 2, and concerning its tuft replacement-related components, it differs in the respect that its tuft insertion mechanisms are in the form of tufting heads (not shown) that are mounted and travel along a gantry beam 8 which spans transversely over the conveyor 2. Those tufting heads each comprise needle carriage and looper carriage assemblies (not shown) that operate in coordination to insert tufts of yarn into the backing. Then, to form cut pile, a cutting mechanism (not shown) is also utilized.

The pin chain conveyor 2 generally comprises a parallel pair of endless chains which are each looped around a pair of shaft-driven sprockets (not shown), and the computer controls rotation of the shafts to impart the degree and direction of backing movement relative to the tuft removal and insertion mechanisms 4, 6. Pin pads are attached to the chains to grip a sheet of backing material near its lateral edges and allow the conveyor 2 to longitudinally advance and retract the backing via computer-controlled chain rotation. In addition to tensioning the backing, this engagement also effectively prevents lateral displacement of the backing as it travels to and fro during the tuft removal and tuft insertion steps. Ideally, the lateral separation of the pin chains can be adjusted to correspond with the width of a given backing sheet that is to be attached to the conveyor 2.

To execute the initial tuft removal step of the process, while the pin chain conveyor 2 is gripping a sheet of tufted, but uncoated backing material, the conveyor 2 is rotated to advance pertinent areas of the backing toward the tuft removal mechanisms 4. It is anticipated that such a backing will have been previously tufted with one or few "background" color(s) of yarn—that is the color(s) of yarn that the great majority of that backing sheet should display post-process. Then when those backing areas arrive, the removal mechanisms 4 proceed to dislodge and remove tufts residing throughout them, creating a removal footprint. The removal mechanisms 4 can be devices capable of dislodging inserted yarn tufts from the backing by way of plucking, sucking, or abrading them.

Then, either during or after full creation of the tuft removal footprint and according to a stored design plan, as the backing advances such that any portion of the removal footprint reaches the machine's tuft insertion mechanisms 6, yarns are selectively inserted by them, within removal footprint, by color in accordance with that design. It is anticipated that these inserted yarns will be "supplemental" colors of yarn—that is the colors that must be added to the backing withing the removal footprint to create the stored design.

It is contemplated that a preferred machine will further feature mechanisms 10 for coating and tuft locking the portions of the backing that have advanced beyond the insertion mechanisms 6 and no longer contain any significant surface area devoid of tufts.

It is understood that substitutions and equivalents for various elements set forth above may be obvious to those skilled in the art and may not represent a departure from the spirit of the invention. Therefore, the full scope and definition of the present invention is to be set forth by the claims that follow.

What is claimed is:

1. A machine for selectively removing and replacing yarn tufts from a tufted backing sheet, the machine comprising:
- a tuft removal mechanism that wholly removes inserted yarn tufts from a backing fabric to create a tuft removal footprint;
- a tuft insertion mechanism capable of inserting yarn tufts into the backing within the tuft removal footprint; and
- a computer for storing tuft removal and insertion position information and for selectively controlling operation of the removal and insertion mechanisms according thereto.

2. The machine of claim 1, wherein said removal footprint comprises non-contiguous areas.

3. The machine of claim 1, wherein said insertion mechanism is capable of inserting multiple colors of yarns that form a discernable design within the removal footprint.

4. The machine of claim 1, wherein said removal mechanism removes whole yarn tufts from the backing by plucking, sucking, or abrading them therefrom.

5. The machine of claim 1, wherein said removal and insertion mechanisms are travelable relative to the backing.

6. The machine of claim 1, wherein said machine further comprises a conveying mechanism capable of advancing the backing relative to said removal and insertion mechanisms.

7. The machine of claim 6, wherein said conveying mechanism comprises:
- at least one endless chain;
- gripping elements that are disposed along the at least one chain and are configured to engage the backing so that the backing advances, relative to said removal and insertion mechanisms, as the at least one chain moves;
- a drive mechanism configured to impart chain movement; and
- wherein said computer controls the drive mechanism in coordination with the removal footprint.

8. The machine of claim 6, wherein said conveying mechanism is configured to tension the backing multi-directionally.

9. A machine for selectively removing and replacing yarn tufts from a tufted backing sheet, the machine comprising:
- a tuft removal mechanism that wholly removes yarn tufts from a plurality of replacement positions along a backing fabric;
- a tuft insertion mechanism capable of inserting yarn tufts into the backing at the replacement positions; and
- a computer for storing the replacement position information and for selectively controlling operation of the removal and insertion mechanisms in coordination therewith.

10. The machine of claim 9, wherein said insertion mechanism is capable of inserting multiple colors of yarns at the replacement positions to form a discernable design.

11. The machine of claim 9, wherein said removal mechanism removes whole yarn tufts from the backing by plucking, sucking, or abrading them therefrom.

12. The machine of claim 9, wherein said removal and insertion mechanisms are travelable relative to the backing.

13. The machine of claim 9, wherein said machine further comprises a conveying mechanism capable of advancing the backing relative to said removal and insertion mechanisms.

14. The machine of claim 13, wherein said conveying mechanism comprises:
- at least one endless chain;
- gripping elements that are disposed along the at least one chain and are configured to engage the backing so that the backing advances, relative to said removal and insertion mechanisms, as the at least one chain moves;
- a drive mechanism configured to impart chain movement; and
- wherein said computer controls the drive mechanism in coordination with the removal positions.

15. The machine of claim 13, wherein said conveying mechanism is configured to tension the backing multi-directionally.

16. A method for removing and replacing inserted yarn tufts from a tufted backing sheet by design, the method comprising:
- attaching the backing to a retaining mechanism;

removing whole inserted yarn tufts from the backing, according to a predetermined removal footprint, with a removal mechanism; and tufting yarn into the backing, within the removal footprint and according to a predetermined insertion pattern, with a tufting mechanism.

17. The method of claim 16, wherein said removing whole yarn tufts is done by plucking, sucking, or abrading.

18. The method of claim 16, wherein said removal footprint comprises non-contiguous areas.

19. The method of claim 16, wherein said insertion pattern comprises multiple colors of yarns that form a discernable design.

20. The method of claim 16, further comprising bonding inserted yarn tufts to the backing.

* * * * *